US005957752A

United States Patent [19]

Katakura

[11] Patent Number: 5,957,752

[45] Date of Patent: Sep. 28, 1999

[54] GRINDING WHEEL DRESSING METHOD AND DEVICE

[75] Inventor: Kazumasa Katakura, Narashino, Japan

[73] Assignee: Seiko Seiki Kabushiki Kaisha, Japan

[21] Appl. No.: 08/861,781

[22] Filed: May 22, 1997

[51] Int. Cl.[6] ..... B24B 49/00

[52] U.S. Cl. ..... 451/10; 451/56; 451/11; 451/443

[58] Field of Search ..... 451/56, 9, 10, 451/11, 254, 258, 443

[56] References Cited

U.S. PATENT DOCUMENTS

| | | | |
|---|---|---|---|
| 4,073,281 | 2/1978 | Asaeda et al. | 451/443 |
| 4,731,954 | 3/1988 | Lilienfein | 451/56 |
| 4,799,472 | 1/1989 | Tonshoff et al. . | |
| 4,866,887 | 9/1989 | Imai et al. | 451/56 |
| 4,897,967 | 2/1990 | Maruyama et al. . | |
| 4,920,945 | 5/1990 | Wedeniwski | 451/56 |
| 4,945,888 | 8/1990 | Mushardt et al. . | |
| 4,953,522 | 9/1990 | Vetter | 451/56 |
| 5,044,125 | 9/1991 | Lambert, Jr. et al. | 451/27 |
| 5,209,020 | 5/1993 | Feisel | 451/56 |
| 5,315,789 | 5/1994 | Takashi | 451/11 |
| 5,562,526 | 10/1996 | Yoneda et al. | 451/11 |
| 5,620,358 | 4/1997 | Furukawa et al. | 451/56 |

*Primary Examiner*—Eileen P. Morgan
*Attorney, Agent, or Firm*—Adams & Wilks

[57] ABSTRACT

As illustrated, a formed grinding wheel dresser 4 is moved toward a formed grinding wheel 2 and is caused to make approach to it up to a prescribed position in the infeed direction thereof. After the formed grinding wheel dresser 4 has approached the prescribed position, the formed grinding wheel dresser 4 is moved rightward in the thicknesswise direction of the formed grinding wheel 2 and thereby determines a position dzl that is attained when having contacted with the formed grinding wheel 2. Next, the formed grinding wheel dresser 4 is moved leftward and thereby determines a position dz2 that is attained when having contacted with the formed grinding wheel 2. A target position X of the formed grinding wheel dresser 4 in the thicknesswise direction is determined based on the thus-determined both positions dz1 and dz2. The current position of the formed grinding wheel dresser 4 is positionally aligned with the thus-determined target position X. Thereafter, the formed grinding wheel dresser 4 is advanced in the infeed direction to thereby perform infeeding of the formed grinding wheel 2.

8 Claims, 8 Drawing Sheets

GRINDING WHEEL DRESSING METHOD AND DEVICE

BACKGROUND OF THE INVENTION

1. Field of the Invention

The present invention relates to a grinding wheel dressing method for dressing a formed grinding wheel by a formed grinding wheel dresser and a dressing device therefor.

2. Description of the Prior Art

Conventionally, in a case where a formed grinding wheel is dressed (dressed) with the use of a formed grinding wheel dresser, as illustrated in FIG. 10(A) a formed grinding wheel 2 that has been fixed to a grinding wheel spindle 1 and a formed grinding wheel dresser 4 that has been fixed to a grinding wheel dresser spindle 3 are disposed with their outer-peripheral surfaces opposing each other. Whereby, the both are rotated and simultaneously, for example, a peripheral surface of the formed grinding wheel dresser 4 is infed with respect to (pressed against) the use surface of the formed grinding wheel 2, whereupon dressing with respect thereto has hitherto been performed.

In this dressing operation, as illustrated in FIG. 10(B), if the infeed-directional position of the formed grinding wheel dresser 4 is a prescribed position of the formed grinding wheel 2 and no displacement is made in the direction perpendicular to the infeed direction, the amounts of dressing of use surfaces 5 and 6 of the formed grinding wheel 2 by the formed grinding wheel dresser 4 become equalized with each other and fixed between the use surfaces 5 and 6.

However, when during the dressing heat is generated at the contact portions of the formed grinding wheel 2 and formed grinding wheel dresser 4 due to the friction therebetween and as illustrated in FIG. 10(C) the formed grinding wheel dresser 4 is displaced due to the thermal displacement resulting from this heat in the arrow-indicated direction that is perpendicular to the infeed direction thereof, as illustrated the left and right use surfaces 5 and 6 of the formed grinding wheel 2 are not equally dressed with the result that there arises the problem that the amount of the use surface 6 dressed inconveniently become larger than the amount of the use surface 5 dressed.

SUMMARY OF THE INVENTION

In view of the above, the object of the present invention is to provide a grinding wheel dressing method which can make proper the amount of dressing of the formed grinding wheel and a grinding wheel dressing device.

In the invention as described in claim 1, the above object is attained by a first step of moving one of a formed grinding wheel dresser or a formed grinding wheel toward the other thereof up to a prescribed position thereof in the infeed direction with respect to the formed grinding wheel, a second step of, after the both have been moved toward each other up to the prescribed position by the execution of this first step, moving at least one of the formed grinding wheel dresser and formed grinding wheel to the left and right in the thicknesswise direction of the formed grinding wheel to thereby cause contacts between corresponding outer-peripheral surfaces of the formed grinding wheel dresser and formed grinding wheel and thereby detect respective contact positions thereof, a third step of determining based on the detection results of the second step a target position of one of the formed grinding wheel dresser and formed grinding wheel as taken in the thicknesswise direction to thereby bring the formed grinding wheel or formed grinding wheel dresser into positional alignment with the target position, and a fourth step of, after this positional alignment has been performed, moving either one of the formed grinding wheel and formed grinding wheel dresser in the infeed direction with respect to the formed grinding wheel to thereby perform dressing of the formed grinding wheel by the formed grinding wheel dresser.

In the invention as described in claim 2, the above object is attained by comprising a rotating shaft having mounted thereon a formed grinding wheel dresser for dressing a formed grinding wheel, rotating means for rotating the rotating shaft, first moving means for moving the formed grinding wheel dressser that has been mounted on the rotating shaft in the infeed direction with respect to the formed grinding wheel, second moving means for moving the formed grinding wheel dresser that has been mounted on the rotating shaft in a direction perpendicular to the direction of the movement made by the first moving means, contact position detecting means for, by moving the formed grinding wheel dresser in the both directions by the second moving means, causing contact of the formed grinding wheel dresser with left and right use surfaces of the formed grinding wheel and thereby detecting respective contact positions thereof, target position calculating means for determining based on the detection results of the contact position detecting means a target position of the formed grinding wheel dresser as taken in the thicknesswise direction, and control means for controlling the movement of the second moving means so as to move the formed grinding wheel dresser to the target position that has been determined by the target position calculating means.

DETAILED DESCRIPTION OF THE PREFERRED EMBODIMENTS

Embodiments of the present invention will now be explained in detail with reference to FIGS. 1 to 9.

Figure 1:
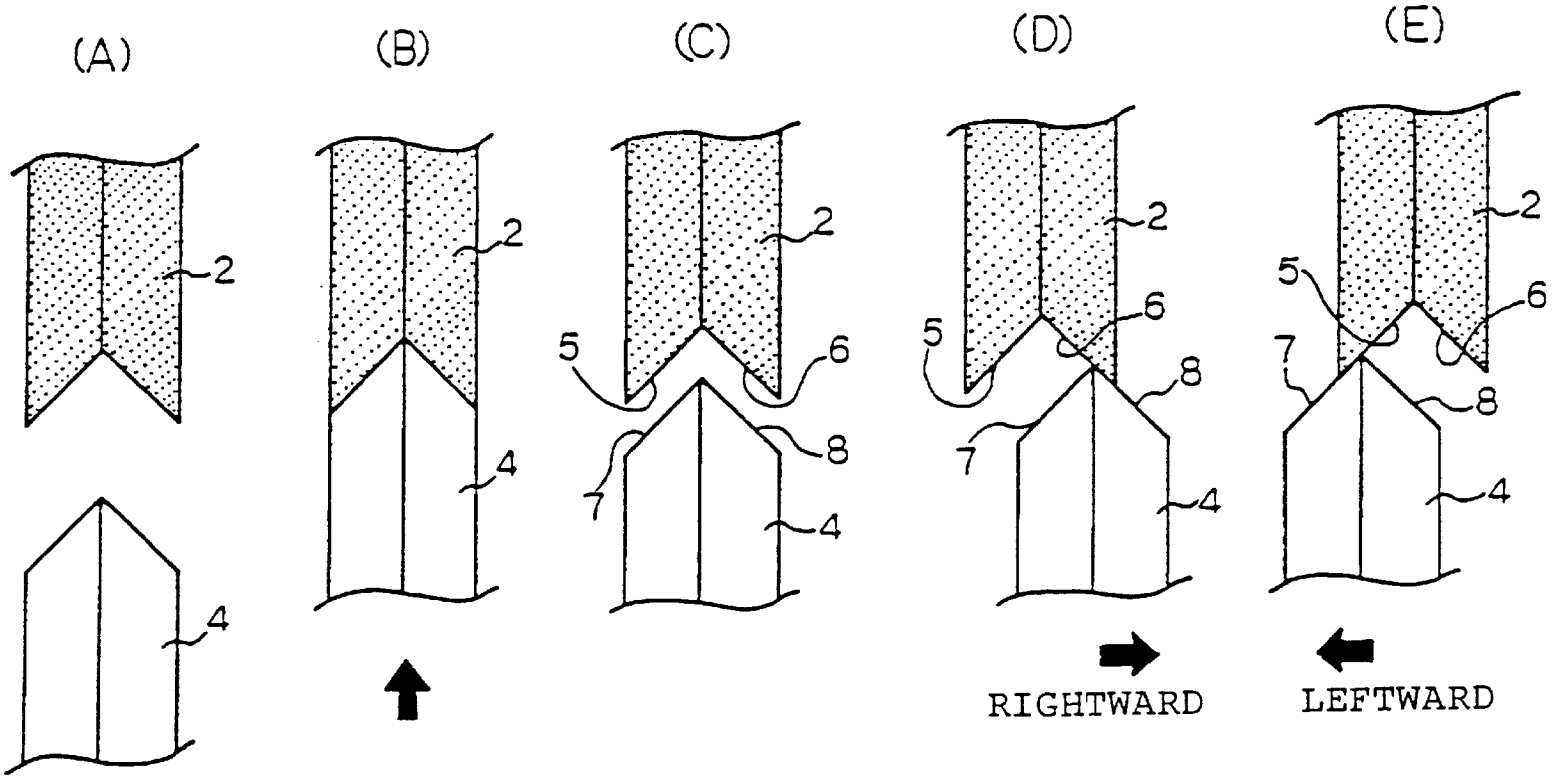
FIGS. 1(A) to 1(E) are step views illustrating a first embodiment of a grinding wheel dressing method according to the present invention.
Figure 2:
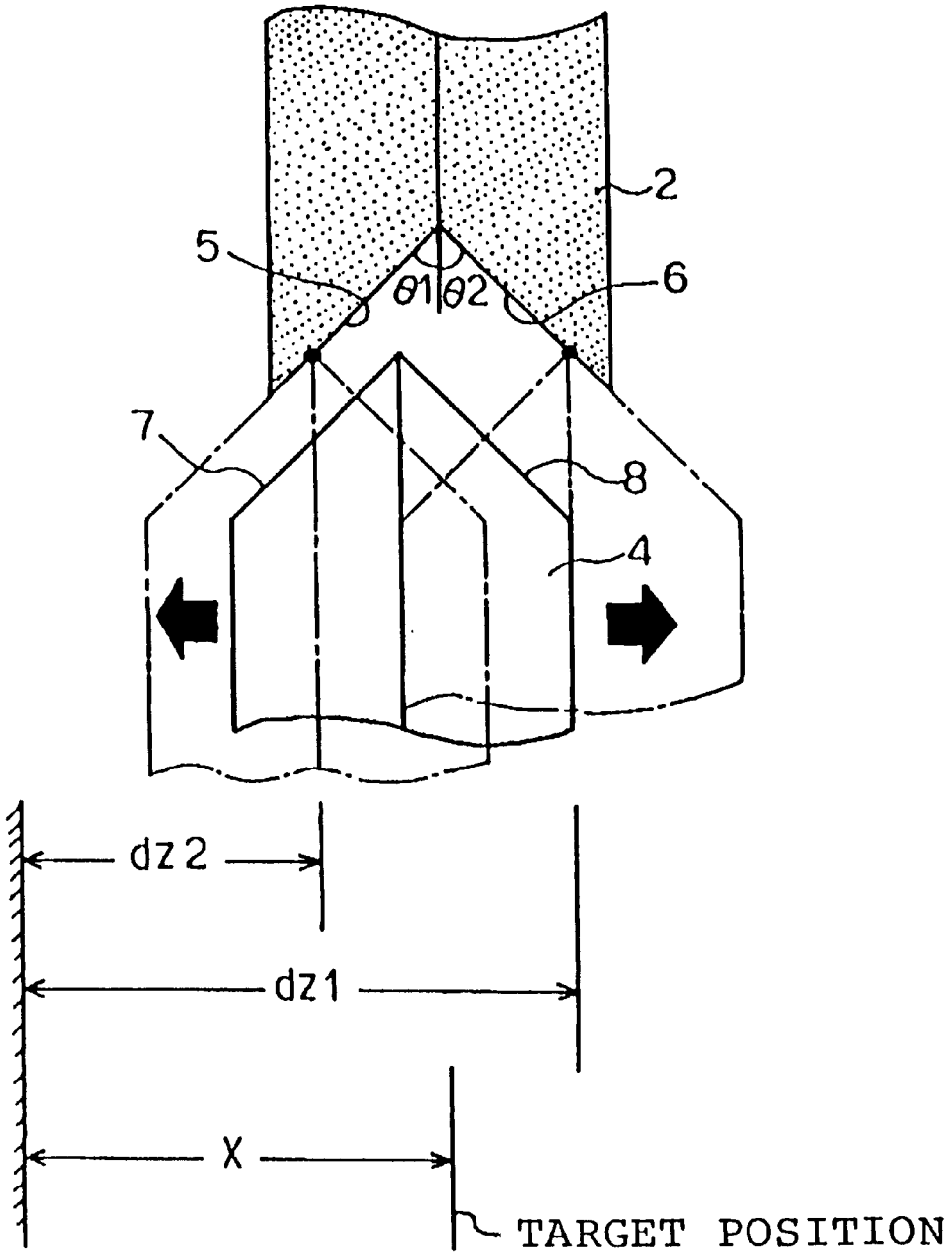
FIG. 2 is a view illustrating the first embodiment.

FIGS. 1(A) to 1(E) are step views illustrating a first embodiment of a grinding wheel dressing method of the present invention. FIG. 2 is a view illustrating the first embodiment.

In the first embodiment of the grinding wheel dressing method, first, as illustrated in FIG. 1(A), a formed grinding wheel 2 that has been fixed to a grinding wheel spindle (not illustrated) and a formed grinding wheel dresser 4 that has been fixed to a grinding wheel dresser spindle (not illustrated) are disposed with their outer-peripheral surfaces opposing each other.

Next, the formed grinding wheel dresser 4 is advanced in the infeed direction with respect to the formed grinding wheel 2 to thereby cause mutual contact of the both as illustrated in FIG. 1(B) and thereby determine the position (coordinate) thereof as taken when the formed grinding wheel 2 and formed grinding wheel dresser 4 have contacted with each other. This position that has been determined is stored. Then, the formed grinding wheel dresser 4 is retreated once up to the position illustrated in FIG. 1(A).

Subsequently, as illustrated in FIG. 1(C), the formed grinding wheel dresser 4 is moved toward the formed grinding wheel 2 up to a prescribed position thereof in the infeed direction with respect thereto, to thereby bring inclined surfaces 7 and 8 of the formed grinding wheel dresser 4 to a state of their being opposed to the use surfaces 5 and 6 of the formed grinding wheel 2.

Next, under the conditions that the formed grinding wheel dresser has approached the prescribed position, as illustrated in FIG. 1(D) the formed grinding wheel dresser 4 is moved rightward in the thicknesswise direction thereof to thereby bring the inclined surface 8 of the formed grinding wheel dresser 4 into contact with the use surface 6 of the formed grinding wheel 2. And, as illustrated in FIG. 2, the formed grinding wheel dresser 4 is moved rightward to thereby determine the thicknesswise position (coordinate) dz1 thereof that has been taken when it has contacted with the formed grinding wheel 2 and store the position thus determined.

Subsequently, as illustrated in FIG. 1(E), the formed grinding wheel dresser 4 is moved leftward in the thicknesswise direction thereof to thereby bring the inclined surface 7 thereof into contact with the use surface 5 of the formed grinding wheel 2. And, as illustrated in FIG. 2, the formed grinding wheel dresser 4 is moved leftward to thereby determine the thicknesswise position (coordinate) dz2 thereof that has been taken when it has contacted with the formed grinding wheel 2 and store the position thus determined.

Subsequently, as illustrated in FIG. 2, a target position X as taken in the thicknesswise direction of the formed grinding wheel dresser 4 is determined based on the both positions dz1 and dz2 that are stored by being determined as mentioned above. This target position X is determined according to the following equation (1).

$$X=dz2+(dz1-dz2)/2 \quad (1)$$

The reason why the target- position X can be determined according to this equation (1) is because there is utilized the nature that, as illustrated in FIG. 2, an angle of inclination θ1 that is defined between the use surface 5 and a vertical line of the formed grinding wheel 2 and an angle of inclination θ2 that is defined between the use surface 6 thereof and the vertical line are the same.

Next, the formed grinding wheel dresser 4 is moved rightward from the position of FIG. 1(E), whereby the current position thereof is positionally aligned (corrected) so as to be located at the target position X thus determined.

By this positional alignment, as illustrated in FIG. 2, the formed grinding wheel dresser 4 which before the positional alignment is made has been located at a solid-line position and not at the target position X can be positioned reliably to the target position X.

Subsequently, the formed grinding wheel 2 is set while its position is being kept unmoved to a state of rotation and, while the formed grinding wheel dresser 4 is being rotated, this dresser 4 is moved in the infeed direction with respect thereto and pressed against the formed grinding wheel 2 to thereby perform dressing with respect to the use surfaces 5 and 6 of the formed grinding wheel 2.

Accordingly, in this dressing operation of the formed grinding wheel 2, since the formed grinding wheel dresser 4 has its target position determined at its thicknesswise position, the use surfaces 5 and 6 of the formed grinding wheel 2 have their amounts of dressing equalized with each other, thereby being dressed properly. It is to be noted that the amount of infeed of the formed grinding wheel dresser 4 with respect to the formed grinding wheel 2 is to an extent of approximately 2 microns.

Next, a second embodiment of the grinding wheel dressing method according to the present invention will now be explained with reference to FIG. 3.

Figure 3:
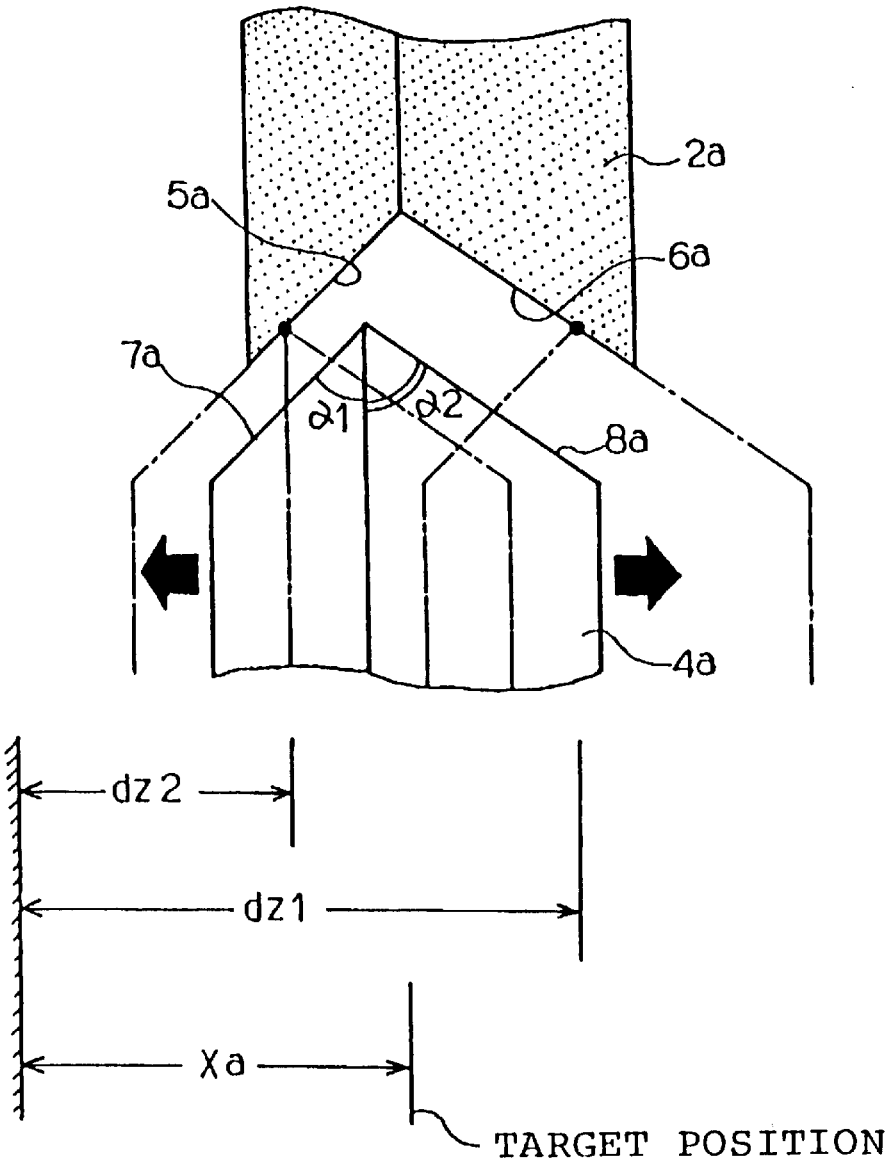
FIG. 3 is a view illustrating a second embodiment of the grinding wheel dressing method according to the present invention.

FIG. 3 is a view illustrating the second embodiment of the grinding wheel dressing method according to the present invention.

In this second embodiment, as in the case of a formed grinding wheel 2*a* illustrated in FIG. 3, the angles of inclination of use surfaces 5*a* and 6*a* thereof differ from each other between the left and right and there is used correspondingly a formed grinding wheel dresser 4*a* whose inclined surfaces 7*a* and 8*a* have angles of inclination conformed thereto to thereby dress the formed grinding wheel 2*a* in accordance with the same procedure as that in the case of the first embodiment.

Accordingly, in this second embodiment, since as a result of the fact that the configuration of the formed grinding wheel 2*a* differs from that of the formed grinding wheel 2 the method of calculating a target position X*a* of the formed grinding wheel dresser 4*a* differ, this difference will now be explained mainly with reference to FIG. 3.

Namely, in this second embodiment, as illustrated in FIG. 3, since the angles of inclination of the use surfaces 5*a* and 6*a* of the formed grinding wheel 2*a* differ from each other between the left and right, the target position X*a* of the formed grinding wheel 2*a* can be determined according to the following equation (2).

$$Xa=dz2+(dz1-dz2)/(1+\tan a2/\tan a1) \quad (2)$$

Here, the dz2 in the equation (2) represents a contact position that has been attained when the formed grinding wheel dresser 4*a* is moved leftward and has contacted with the formed grinding wheel 2*a* and the dz1 represents a contact position that has been attained when the formed grinding wheel dresser 4*a* is moved rightward and has contacted with the formed grinding wheel 2*a*. Also, the a1 represents an angle of inclination of the inclined surface 7*a* of the formed grinding wheel dresser 4*a* and the a2 represents an angle of inclination of the inclined surface 8*a* thereof.

The reason why the target position X*a* can be determined according to this equation (2) is because there is utilized the nature that an angle of inclination a1 of the inclined surface 7*a* of the formed grinding wheel dresser 4*a* and an angle of inclination a2 of the inclined surface 8*a* thereof are each already known.

Accordingly, in this second embodiment, the formed grinding wheel dresser 4 is moved rightward from the position of FIG. 1(E), whereby the current position of the formed grinding wheel dresser 4*a* is positionally aligned (corrected) so as to be located at the target position X*a* thus determined.

By this positional alignment, as illustrated in FIG. 3, the formed grinding wheel dresser 4*a* which before the positional alignment is mad(e has been located at a solid-line position and not at the tar(get position X*a* can be positioned reliably to the target position X*a*.

Next, a third embodiment of the grinding wheel dressing method according to the present invention will be explained with reference to FIG. 4.

Figure 4:
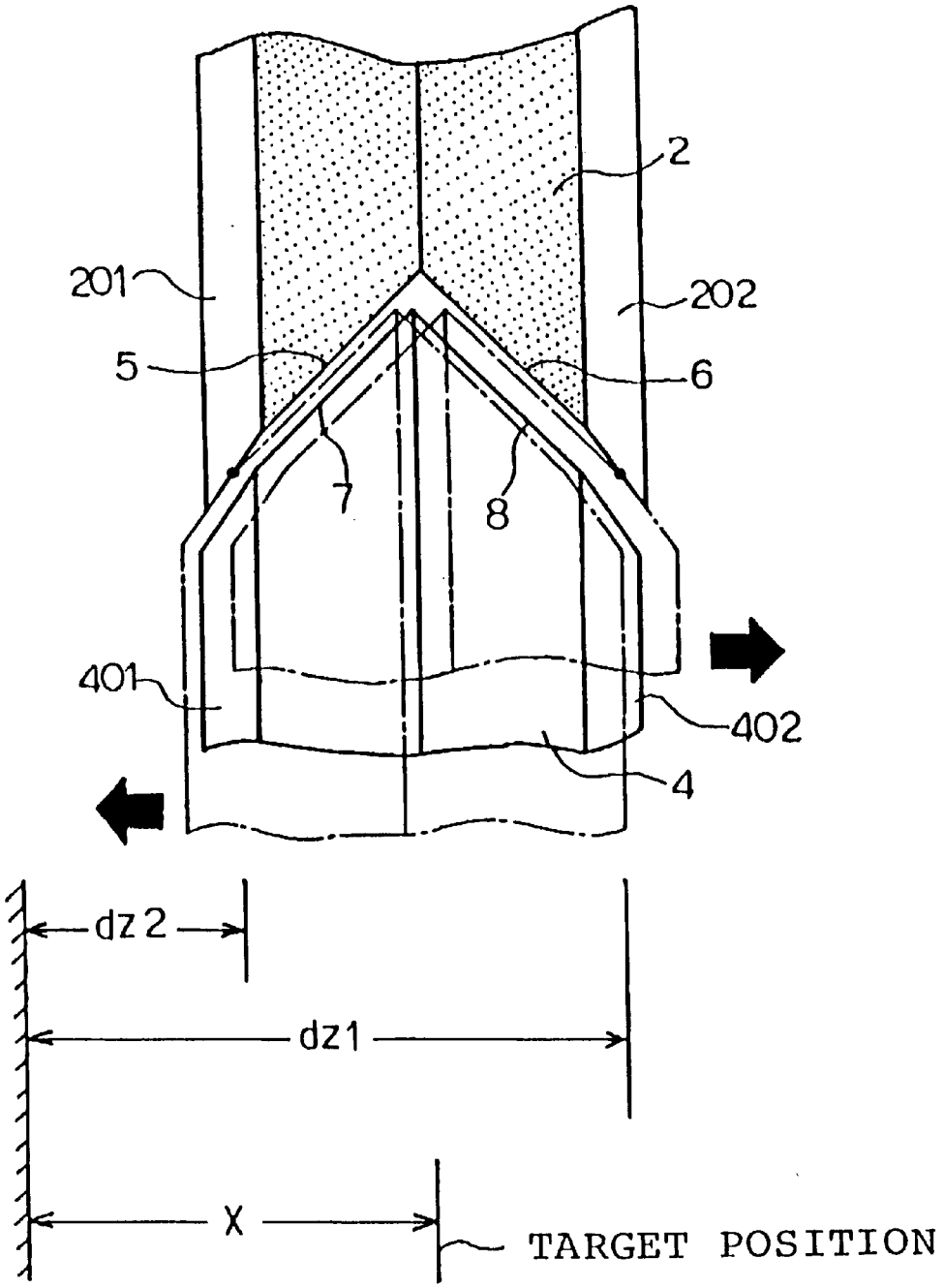
FIG. 4 is a view illustrating a third embodiment of the grinding wheel dressing method according to the present invention.

FIG. 4 is a view illustrating the third embodiment of the dressing method of the grinding wheel according to the present invention.

In this third embodiment, as illustrated in FIG. 4, bisymmetrical position-detecting reference surfaces 201 and 202 are specially provided respectively on left and right side surfaces of the formed grinding wheel 2, and position-detecting reference surfaces 401 and 402 are correspondingly provided respectively on left and right side surfaces of the formed grinding wheel dresser 4, whereby the target position X of the formed grinding wheel dresser 4 is determined using the reference surfaces 201, 202 and reference surfaces 401, 402 in the same way as in the first embodiment. And, in the case of the first embodiment, the formed grinding wheel dresser 4 is positionally aligned with the target position X thus determined to thereby perform dressing of the formed grinding wheel 2 by the formed grinding wheel dresser 4.

Here, the portions of contact of the reference surfaces 201 and 202 provided on the formed grinding wheel 2 are each largely inclined more inward than the acting surfaces 5 and 6 thereof. Correspondingly, the portions of contact of the reference surfaces 401 and 402 also have their angles of inclination set to be larger than those of the inclined surfaces 7 and 8 of the formed grinding wheel dresser 4 to thereby prevent the inclined surfaces 7 and 8 of the formed grinding wheel dresser 4 from contacting with the acting surfaces 5 and 6 of the formed grinding wheel 2 when the reference surfaces 401 and 402 contact with the reference surfaces 201 and 202.

Figure 5:
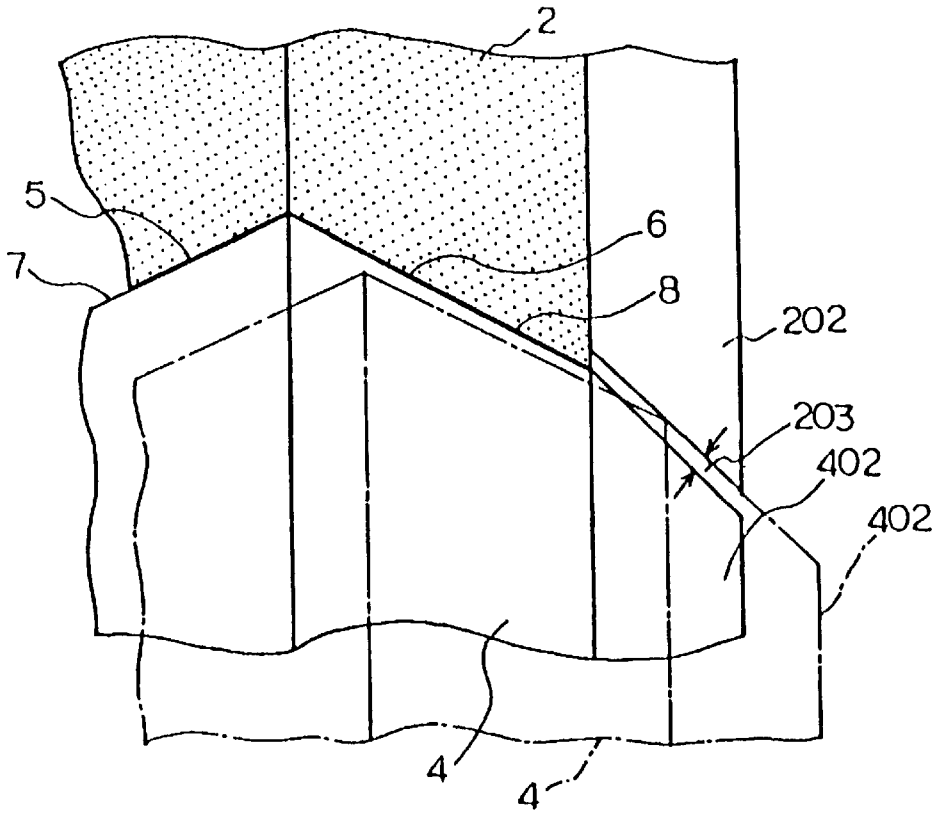
FIG. 5 is a view illustrating a modification of the third embodiment thereof.

It is to be noted that, preferably, as illustrated in FIG. 5, the reference surface 202 of the formed grinding wheel 2 has its portion of contact inwardly cut in by a prescribed amount to thereby provide a gap 203. In this respect, the reference surface 201 (see FIG. 4) of the formed grinding wheel 2 is made same.

If this gap 203 is provided beforehand, when infeeding is performed by the formed grinding wheel dresser 4 the inclined surfaces 7 and 8 of the formed grinding wheel dresser 4 can be brought into contact with only the acting surfaces 5 and 6 alone of the formed grinding wheel 2 as indicated by a solid line of FIG. 5 while, on the other hand, when positional detection is performed of the formed grinding wheel dresser 4 the reference surface 402 can be brought into contact with only the reference surface 202 alone as indicated in a one-dot chain line of FIG. 5. Here, although not illustrated in FIG. 5, the same applies to the relationship between the reference surface 401 and the reference surface 201.

It is to be noted that it may be also arranged that the same gap as the one 203 as mentioned above is provided to each of the reference surfaces 401 and 402 of the formed grinding wheel dresser 4 side.

As has been explained above, in each of the embodiments of the grinding wheel dressing method, since when the formed grinding wheel is dressed using the formed grinding wheel dresser it has been arranged that the thicknesswise position of the formed grinding wheel dresser is aligned with (corrected to) the target position and thereafter the formed grinding wheel dresser dresses the formed grinding wheel, it is possible to prevent the displacement of the formed grinding wheel dresser in the thicknesswise direction to thereby make equal to each other the amounts of dressing of the left and right use surfaces of the formed grinding wheel.

Also, in each of the above-mentioned embodiments, reference has been made to the case where the formed grinding wheel dresser 4 is moved with the formed grinding wheel 2 side being kept fixed or the case where the formed grinding wheel dresser 4*a* is moved with the formed grinding wheel 2*a* side being kept fixed.

However, the grinding wheel dressing method according to the present invention can of course be realized by, conversely to the above-mentioned case, moving the formed grinding wheel 2 with the formed grinding wheel dresser 4 side being kept fixed or moving the formed grinding wheel 2*a* with the formed grinding wheel dresser 4*a* side being kept fixed.

Next, an embodiment of the grinding wheel dressing device will be explained with reference to the drawings.

Figure 6:
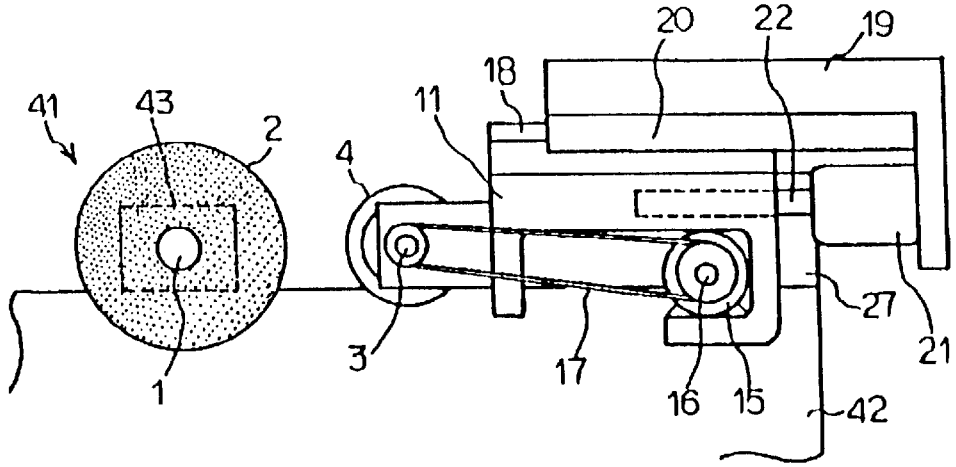
FIG. 6 is a front view illustrating an embodiment of a grinding wheel dressing device according to the present invention.
Figure 7:
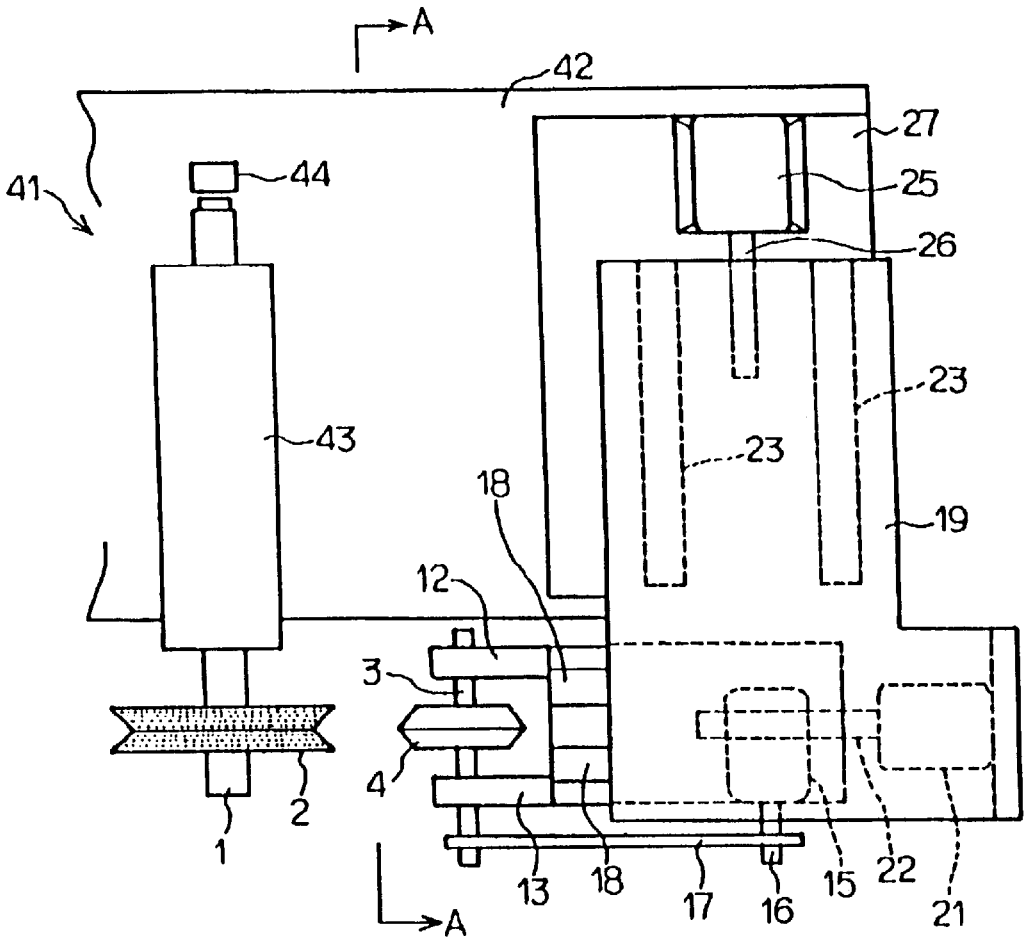
FIG. 7 is a plan view illustrating the grinding wheel dressing device.
Figure 8:
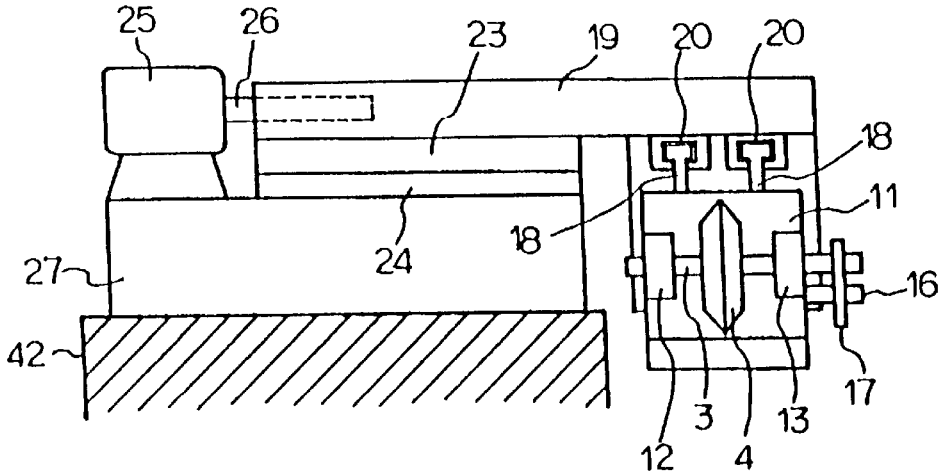
FIG. 8 is a view taken along a line A—A of FIG. 7.

FIG. 6 is a front view illustrating a grinding wheel dressing device according to this embodiment. FIG. 7 is a plan view illustrating the grinding wheel dressing device. FIG. 8 is a view taken along a line A—A of FIG. 7.

As illustrated, this grinding wheel dressing device has an infeed portion 11 for intending of the formed grinding wheel dresser 4 with respect to the formed grinding wheel 2. At a front portion of this infeed portion 11, a dresser spindle 3 is borne by left and right bearings 12 and 13. The formed grinding wheel dresser 4 is rotatably mounted on this dresser spindle 3.

At a bottom portion of the rear side of the infeed portion 11 there is mounted a dresser driving motor 15. A rotating shaft 16 of the dresser driving motor 15 and the dresser spindle 3 are connected to each other by means of a belt 17 so that the formed grinding wheel dresser 4 can be rotated by the rotation of the dresser driving motor 15.

As illustrated in FIGS. 6 and 8, on the infeed portion 11 there are fixed left and right slide members 18, 18 in the lengthwise direction thereof, which slide members 18, 18 are slidably fitted in guide rails 20, 20 that are fixed to the underside of a connection movement portion 19.

As illustrated in FIG. 6, screw connected to a rear end portion of the infeed portion 11 is a rotating shaft 22 of an infeeding motor 21 that is mounted on a part of the correction movement portion 19 so that the infeed portion 11 can be advanced or retreated by the rotation of this rotating shaft 22.

Accordingly, when the rotating shaft 22 of the infeeding motor 21 is forward or reverse rotated, the infeed portion 11 is slid while the slide members 18, 18 are being guided by the guide rails 20, 20, thereby being advanced toward or retreated from the use surface of the formed grinding wheel 2.

Fixed to the underside of the correction movement portion 19 in the lengthwise direction thereof as illustrated in FIGS. 7 and 8 are a pair of left/right slide members 23, 23 which are fixed on the upper surface of a fixed base 27 and which are slidably fitted into guide rails 24, 24.

Screw connected to a rear end portion of the correction movement portion 19 is a rotating shaft 26 of a correction motor 25 that is fixed to the fixed base 27 so that the correction movement portion 19 can be advanced or retreated by the rotation thereof in the thicknesswise direction of the formed grinding wheel dresser 4.

Accordingly, when the. rotating shaft 26 of the correction motor 25 is forward or reverse rotated, the correction movement portion 19 can be moved in the thicknesswise direction of the formed grinding wheel dresser 4 by the slide members 23, 23 being slid while they are being guided by the guide rails 24, 24.

As illustrated in FIG. 7, the fixed base 27 is mounted on a fixed base 42 of the grinding machine 41. On this fixed base 42 there is provided a grinding wheel spindle unit 43 for rotating the formed grinding wheel 2 with this wheel 2 being mounted on the grinding wheel spindle 1. This grinding wheel spindle unit 43 is constructed though not illustrated in such a manner as to be freely movable in the X, Y and Z directions.

Also, on one end of the grinding wheel spindle 1 there is provided a contact senior 44 for detecting the contact of the formed grinding wheel dresser 4 with the formed grinding wheel 2. This contact sensor 44 consists of, for example, an AE sensor (acoustic emission sensor).

Next, a block diagram of a control system for controlling the above-constructed grinding wheel dressing device will be explained with reference to FIG. 9.

Figure 9:
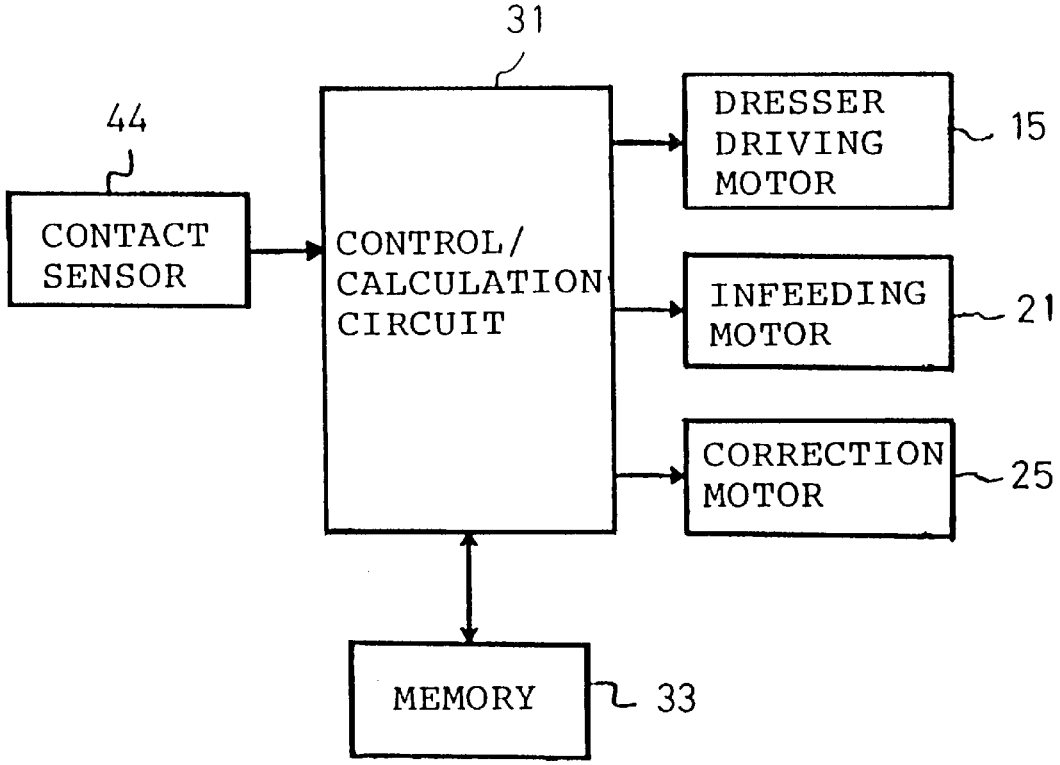
FIG. 9 is a block diagram illustrating a control system of the grinding wheel dressing device. And, FIGS. 10(A), 10(B) and 10(C) are views each illustrating a conventional grinding wheel dressing method.
Figure 10:
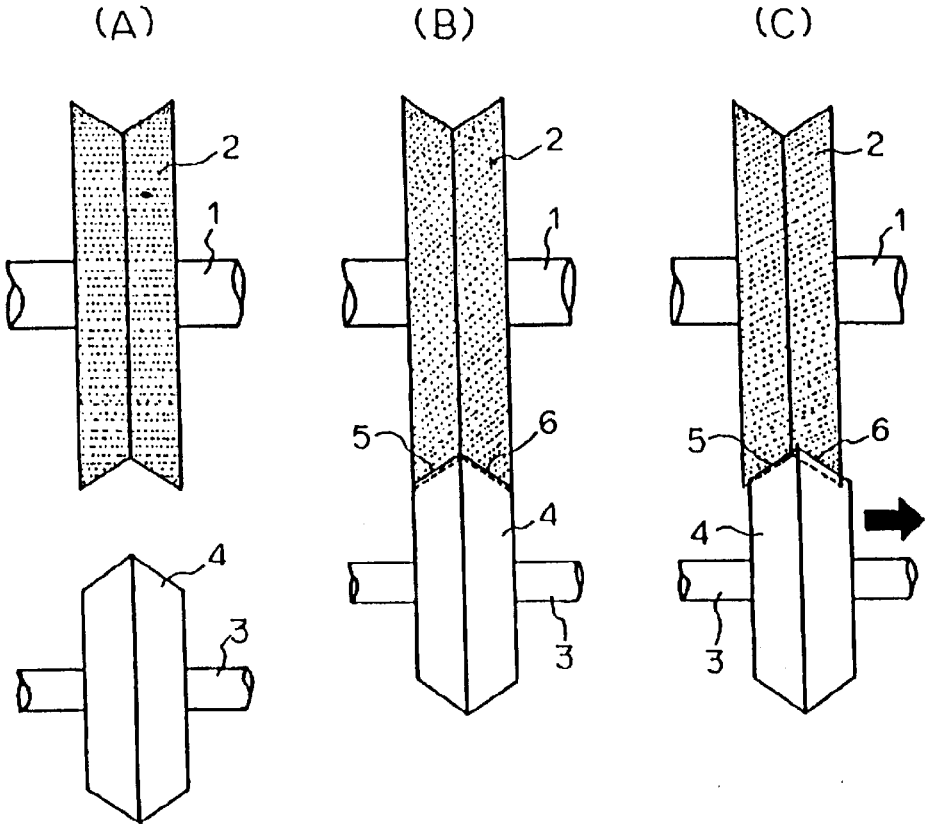
FIG. 10 PRIOR ART

This grinding wheel dressing device is equipped with a control/calculation circuit 31 for controlling the respective portions and performing prescribed calculations as illustrated in FIG. 9. This control/calculation circuit 31 is constructed of, for example, a microcomputer and has connected thereto a memory 33 for storing data therein.

The contact sensor 44 is connected to the input side of the control/calculation circuit 31. Also, to the output side thereof there are connected the dresser driving motor 15, infeeding motor 21 and correction motor 25 that are objects to be controlled.

Next, an example of the operation of the above-constructed grinding wheel dressing device will be explained with reference to the drawings.

In this grinding wheel dressing device, first, the control/calculation circuit 31 causes forward rotation of the infeeding motor 21 and thereby advances the formed grinding wheel dresser 4 from a prescribed position toward the formed grinding wheel 2. Upon detection of the contact between the two by the contact sensor 44, the control/calculation circuit 31 determines the position (coordinate) at which the two have contacted with each other based on this detection and stores this determined position into the memory 33. Then, it causes reverse rotation of the infeeding motor 21 and thereby retreats the formed grinding wheel dresser 4 once up to the prescribed position.

Next, the infeeding motor 21 is forward rotated again to thereby cause the approach of the formed grinding wheel dresser 4 to a prescribed position of the formed grinding wheel 2 so as to bring the inclined surfaces 7 and 8 to a state of its opposing the use surfaces 5 and 6 of the formed grinding wheel 2 as illustrated in FIG. 1(C).

Under the condition that the formed grinding wheel dresser 4 has approached up to the prescribed position, the correction motor 25 is forward rotated and, as illustrated in FIG. 1(D), the formed grinding wheel dresser 4 is moved leftward in the thicknesswise direction. Upon detection by the contact sensor 44 of contact of the inclined surface 7 of the formed grinding wheel dresser 4 with the use surface 5 of the formed grinding wheel 2, determination is made of the thicknesswise contact position (coordinate) of the formed grinding wheel dresser 4 that is attained when this detection has been made and storage thereof is made into the memory 33.

Subsequently, the correction motor 25 is reverse rotated to thereby move the formed grinding wheel dresser 4 rightward in the thicknesswise direction thereof as illustrated in FIG. 1(E). Upon detection by the contact sensor 44 of contact of the inclined surface 8 of the formed grinding wheel dresser 4 with the use surface 6 of the formed grinding wheel 2, determination is made of the thicknesswise contact position (coordinate) of the formed grinding wheel dresser 4 that is attained when this detection has been made and storage thereof is made into the memory 33.

Subsequently, based on the above-mentioned both contact positions that are stored in the memory 33, the control/calculation circuit 31 determines a thicknesswise target position of the formed grinding wheel dresser 4 according to the above-mentioned equation (1) (see FIG. 2).

Next, by moving the formed grinding wheel dresser 4 leftward from the position of FIG. 1(E) the current position thereof is positionally aligned (corrected) so as to be located at the thus-determined target position.

Upon completion of this positional alignment, the formed grinding wheel dresser 4 is moved in the infeed direction while being rotated by the drive of the dresser driving motor 15 and is pressed thereagainst to thereby dress the use surfaces 5 and 6 of the formed grinding wheel 2.

Accordingly, since the formed grinding wheel dresser 4 can performed infeeding with respect to the formed grinding wheel 2 while the thicknesswise position thereof is maintained to be at the target position, the amounts of dressing of the use surfaces 5 and 6 of the formed grinding wheel 2 become equalized with each other, with the result that proper dressing thereof can be performed.

As has been explained above, according to the present invention, since when the formed grinding wheel is dressed using the formed grinding wheel dresser the target position of the formed grinding wheel or formed grinding wheel dresser is determined and the formed grinding whel or formed grinding wheel dresser has been positionally aligned with the thus-determined position, the amount of dressing of the formed grinding wheel can be mad(e to be proper.

What is claimed is:

1. A grinding wheel dressing method, comprising the steps of:

moving one of a grinding wheel dresser and a grinding wheel toward the other in an infeed direction up to a prescribed position;

thereafter moving at least one of the grinding wheel dresser and grinding wheel in left and right directions along a direction of a thickness of the grinding wheel to bring corresponding outer-peripheral surfaces of the grinding wheel dresser and the grinding wheel into contact with one another at respective contact positions thereof;

detecting the respective contact positions of the grinding wheel dresser and the grinding wheel;

determining a target position of one of the grinding wheel dresser and grinding wheel based on the detected contact positions;

moving one of the grinding wheel dresser and grinding wheel for which the target position has been determined to the target position; and thereafter moving one of the grinding wheel and grinding wheel dresser for which the target position has been determined in the infeed direction to perform dressing of the grinding wheel by the grinding wheel dresser.

2. A grinding wheel dressing device comprising:

a grinding wheel;

a rotational shaft;

rotating means for rotating the rotational shaft;

a grinding wheel dresser mounted on the rotational shaft for rotation therewith and for dressing the grinding wheel;

first moving means for moving the grinding wheel dresser in a first direction towards the grinding wheel;

second moving means for moving the grinding wheel dresser in a second direction perpendicular to the first direction to bring corresponding surfaces of the grinding wheel dresser and the grinding wheel into contact with one another at respective contact positions;

contact position detecting means for detecting the respective contact positions of the corresponding surfaces of the grinding wheel dresser and the grinding wheel;

target position calculating means for calculating a target position of the grinding wheel dresser based on the contact positions detected by the contact position detecting means; and control means for controlling the movement of the second moving means to move the grinding wheel dresser to the target position calculated by the target position calculating means.

3. A grinding wheel dressing device as claimed in claim 2; wherein the control means includes means for controlling the movement of the second moving means to move the grinding wheel dresser in the second direction from the target position to perform dressing of the grinding wheel.

4. A grinding wheel dressing device as claimed in claim 3; wherein the control means includes storing means for storing the contact positions detected by the contact position detecting means.

5. A grinding wheel dressing method, comprising the steps of:

providing a grinding wheel having first and second grinding surfaces;

providing a rotational grinding wheel dresser having first and second dressing surfaces and mounted for rotation about a rotational axis;

disposing the grinding wheel dresser at a preselected position so that the first and second dressing surfaces of the grinding wheel dresser are in spaced-apart, confronting relation to the first and second grinding surfaces of the grinding wheel;

moving the grinding wheel dresser in a first direction generally parallel to the rotational axis thereof to bring the first dressing surface of the grinding wheel dresser into contact with the first grinding surface of the grinding wheel at a first contact position;

moving the grinding wheel dresser in a second direction opposite to the first direction to bring the second dressing surface of the grinding wheel dresser into contact with the second grinding surface of the grinding wheel at a second contact position;

determining a target position for the grinding wheel dresser based on the first and second contact positions;

moving the grinding wheel dresser to the target position; and moving the grinding wheel dresser toward the grinding wheel in a third direction generally perpendicular to the first and second directions while rotating the grinding wheel dresser to dress the first and second grinding surfaces of the grinding wheel by the first and second surfaces, respectively, of the grinding wheel dresser.

6. A grinding wheel dressing method as claimed in claim 5; including the step of storing the first and second contact positions in a storage circuit before determining the target position.

7. A dressing device comprising:

a base;

a grinding member having grinding surfaces;

a dressing member having dressing surfaces for dressing the grinding member and mounted on the base for relative movement thereto;

a first moving mechanism for moving the dressing member in a first direction toward the grinding member and a second direction away from the grinding member;

a second moving mechanism for moving the dressing member in a third direction at an angle relative to the first direction and in a fourth direction opposite the third direction to bring corresponding surfaces of the dressing member and the grinding member into contact with one another at respective contact positions;

a calculating device for calculating a target position for the dressing member based on the contact positions of the grinding surfaces of the grinding member and the dressing surfaces of the dressing member; and a control device for controlling movement of at least one of the first and second moving mechanisms to move the dressing member to a preselected position so that the dressing surfaces of the dressing member are in spaced-apart, confronting relation to the first and second grinding surfaces of the grinding member, controlling movement of the second moving mechanism to move the dressing member in the third and fourth directions to bring the corresponding surfaces of the dressing member and the grinding member into contact with one another at the respective contact positions, controlling movement of the first moving mechanism to move the dressing member in the second direction to the target position upon calculation thereof by the calculating device, and controlling movement of the first moving mechanism to move the dressing member in the first direction from the target position to perform dressing of the grinding surfaces of the grinding member by the dressing surfaces of the dressing member.

8. A dressing device as claimed in claim 7; wherein the calculating device includes a storing circuit for storing the contact positions of the grinding surfaces of the grinding member and the dressing surfaces of the dressing member.

* * * * *